US008978399B2

(12) United States Patent
Popov

(10) Patent No.: US 8,978,399 B2
(45) Date of Patent: Mar. 17, 2015

(54) HEAT PUMPING UNIT AND VARIANTS THEREOF

(71) Applicant: Serguei A. Popov, Houston, TX (US)

(72) Inventor: Serguei A. Popov, Houston, TX (US)

( * ) Notice: Subject to any disclaimer, the term of this patent is extended or adjusted under 35 U.S.C. 154(b) by 243 days.

(21) Appl. No.: 13/740,545

(22) Filed: Jan. 14, 2013

(65) Prior Publication Data

US 2014/0196494 A1 Jul. 17, 2014

(51) Int. Cl.
*F25B 19/02* (2006.01)
*F25B 30/02* (2006.01)

(52) U.S. Cl.
CPC ..... *F25B 30/02* (2013.01)
USPC ..... 62/170; 62/500

(58) Field of Classification Search
CPC ..... F25B 30/02
USPC ..... 62/426, 500, 118, 170, 280; 165/908
See application file for complete search history.

(56) References Cited

U.S. PATENT DOCUMENTS 3,277,660 A 10/1966 Kemper et al.
3,659,401 A 5/1972 Giammarco
4,007,776 A * 2/1977 Alkasab ..... 165/236
5,209,284 A * 5/1993 Okamoto et al. ..... 165/292
6,398,918 B1 * 6/2002 Popov ..... 203/2
6,675,609 B2 * 1/2004 Takeuchi et al. ..... 62/500
7,061,763 B2 * 6/2006 Tsoi ..... 361/699
7,086,248 B2 8/2006 Sakai et al.
7,254,961 B2 8/2007 Oshitani et al.
7,399,545 B2 * 7/2008 Fly ..... 429/435
8,012,247 B2 9/2011 Popov et al.
2004/0231833 A1 * 11/2004 Wang et al. ..... 165/202
2005/0048339 A1 * 3/2005 Fly ..... 429/26
2005/0083654 A1 * 4/2005 Tsoi ..... 361/699
2009/0292084 A1 * 11/2009 Sellmann et al. ..... 526/64
2010/0258007 A1 * 10/2010 Popov et al. ..... 96/146
2010/0313582 A1 * 12/2010 Oh et al. ..... 62/115
2011/0220729 A1 * 9/2011 Bucknell ..... 237/12.3 R

* cited by examiner

*Primary Examiner* — Mohammad M Ali
(74) *Attorney, Agent, or Firm* — Richard A. Fagin

(57) ABSTRACT

A heat pumping unit includes a first heat exchanger, a second heat exchanger and a pump. An outlet of the first heat exchanger is connected to a vapor inlet of a liquid jet-ejector. A liquid outlet of the ejector is connected to an inlet of the second heat exchanger. An outlet of the second heat exchanger is connected at the same time to an inlet of the pump and through a pressure reducing device to an inlet of the first heat exchanger. The pump outlet is connected to the liquid-jet ejector liquid inlet.

7 Claims, 5 Drawing Sheets

HEAT PUMPING UNIT AND VARIANTS THEREOF

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

This disclosure is related to the field of refrigeration and heat pumping technology, primarily, but not exclusively to home and industrial applications.

An ejector heat cycle device is known in the art using oil in a refrigeration recycle loop comprising a heater-cooler system. In such device, refrigerant circulates through a cooler absorbing heat from outside of the cycle, and then through the heater exchanges excess heat to the outside of the refrigeration cycle. In the foregoing device the heater is connected with a cooler through an ejector and a separator. The ejector motive fluid is a second liquid—immiscible with the refrigerant fluid—is circulated by a mechanical compressor (see, e.g., U.S. Pat. No. 7,086,248 issued to Sakai et al. on Aug. 8, 2006, incorporated herein by reference).

There is a need for a method and system having higher energy efficiency than the device shown in the Sakai et al. '248 patent.

SUMMARY

One aspect of the invention is a heat pumping unit including a first heat exchanger, a second heat exchanger and a pump. An outlet of the first heat exchanger is connected to a vapor inlet of a liquid jet-ejector. A liquid outlet of the ejector is connected to an inlet of the second heat exchanger. An outlet of the second heat exchanger is connected at the same time to an inlet of the pump and through a pressure reducing device to an inlet of the first heat exchanger. The pump outlet is connected to the liquid-jet ejector liquid inlet.

Other aspects and advantages of the invention will be apparent from the description and claims which follow.

DETAILED DESCRIPTION

Figure 1:
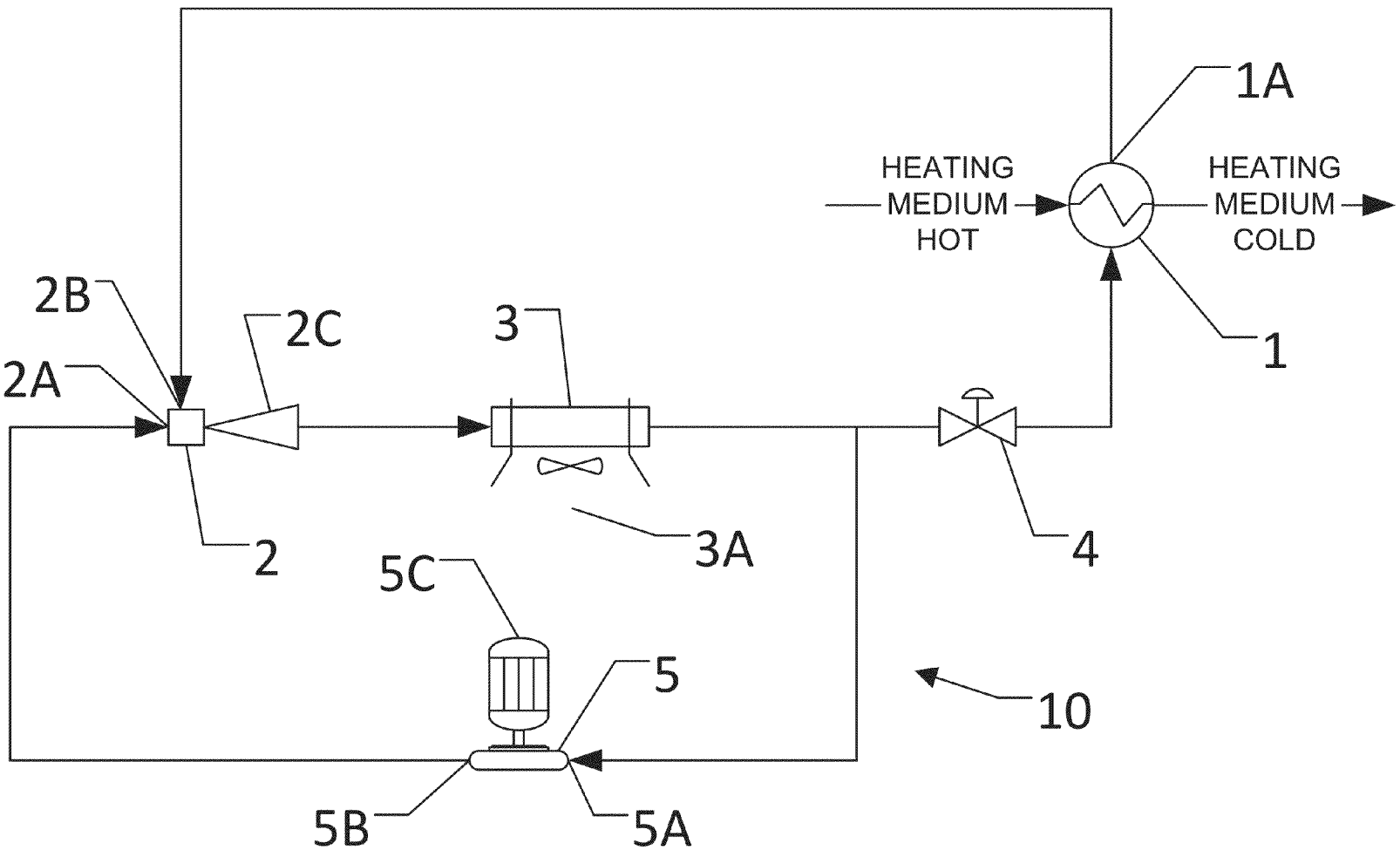
FIG. 1 is a schematic diagram of an example refrigeration and heat pumping unit.

FIG. 1 is a schematic diagram of an example refrigeration and heat pumping unit. A first heat exchanger (1) which in the present example may be used to extract heat from ambient air passing therethrough, has a vapor outlet port (1A) connected to a vapor inlet port (2B) of a condensing liquid-jet ejector (2) of types well known in the art. The liquid-jet ejector is an apparatus wherein liquid or motive liquid enters under a high pressure through a motive liquid inlet port (2A), then flows through an orifice or nozzle (not shown separately) receiving acceleration. Then the motive liquid moves through ejector feed and mixing chambers (not shown separately) entraining low velocity and low pressure vapors, mixes with the vapors and enters the ejector throat, where the mixture accelerates further by increasing superfacial velocity at a reducing cross-sectional area portion therein. The mixed flow thus achieves supersonic velocity, which creates a shock wave and establishes an increase in the static pressure within the flow that discharges then through a discharge nozzle (2C). The liquid inlet port (2A) of the liquid-jet ejector (2) may be connected to a discharge port (5B) of a circulating pump (5). The circulating pump (5) may be driven by any type of prime mover, such as an electric motor. Condensed liquid from the ejector discharge nozzle (2C) is directed to a second heat exchanger (3), which may have air drawn therethrough using a fan 3A or the like. Ambient air drawn through the second heat exchanger (3) has heat from the liquid passing therethrough discharged into the ambient air stream, thus cooling the liquid. A portion of the liquid cooled in the second heat exchanger (3) is sent to the suction port (5A) of the circulating pump (5), and another portion of the cooled liquid is directed to a pressure reducing device (e.g., a valve) (4) and then to the inlet of the first heat exchanger (1).

Figure 2:
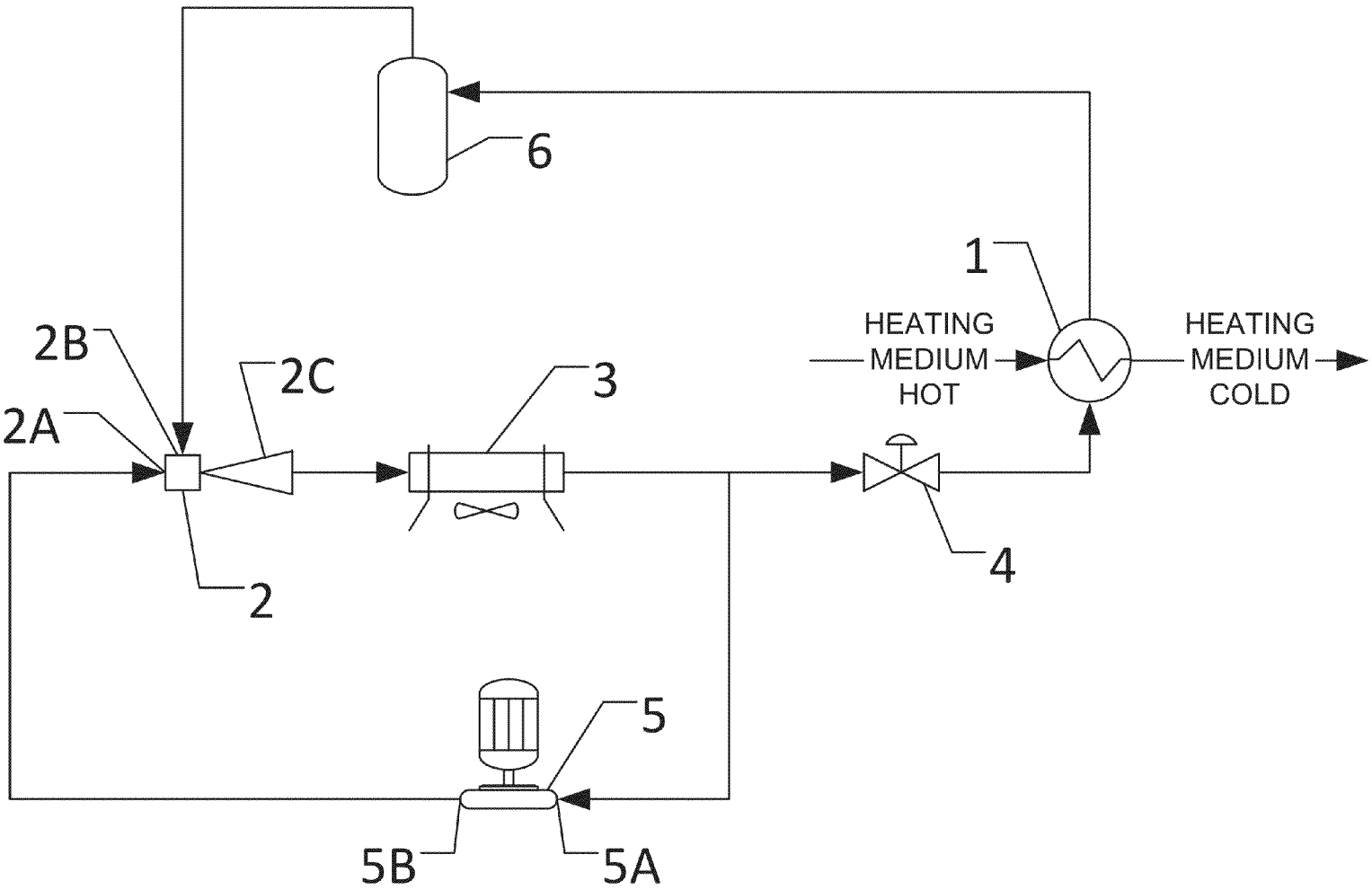
FIG. 2 shows a schematic diagram of the example refrigeration and heat pumping unit, which includes a liquid knockout drum.

FIG. 2 shows a schematic diagram of the example refrigeration and heat pumping unit of FIG. 1, which further includes a liquid knockout drum 6. The liquid knockout drum may be a separator or two-phase separator used to separate vapors from liquid and to prevent liquid that may be entrained with the vapors being sent to the vapor inlet port (2B) of the liquid-jet ejector (2).

The liquid knockout drum (6) has a vapor outlet port connected to the vapor inlet port (2B) of the liquid-jet ejector (2), wherein the liquid inlet port (2A) thereof is connected to the discharge port (5B) of the circulating pump (5). Condensed liquid from the liquid-jet ejector liquid outlet nozzle (2C) is directed to the second heat exchanger (3). Liquid cooled in the second heat exchanger (3) may be directed to the suction port (5A) of the circulating pump (5), and another portion thereof is directed to a pressure reducing device (e.g., a valve) (4) and then to the first heat exchanger (1).

Figure 3:
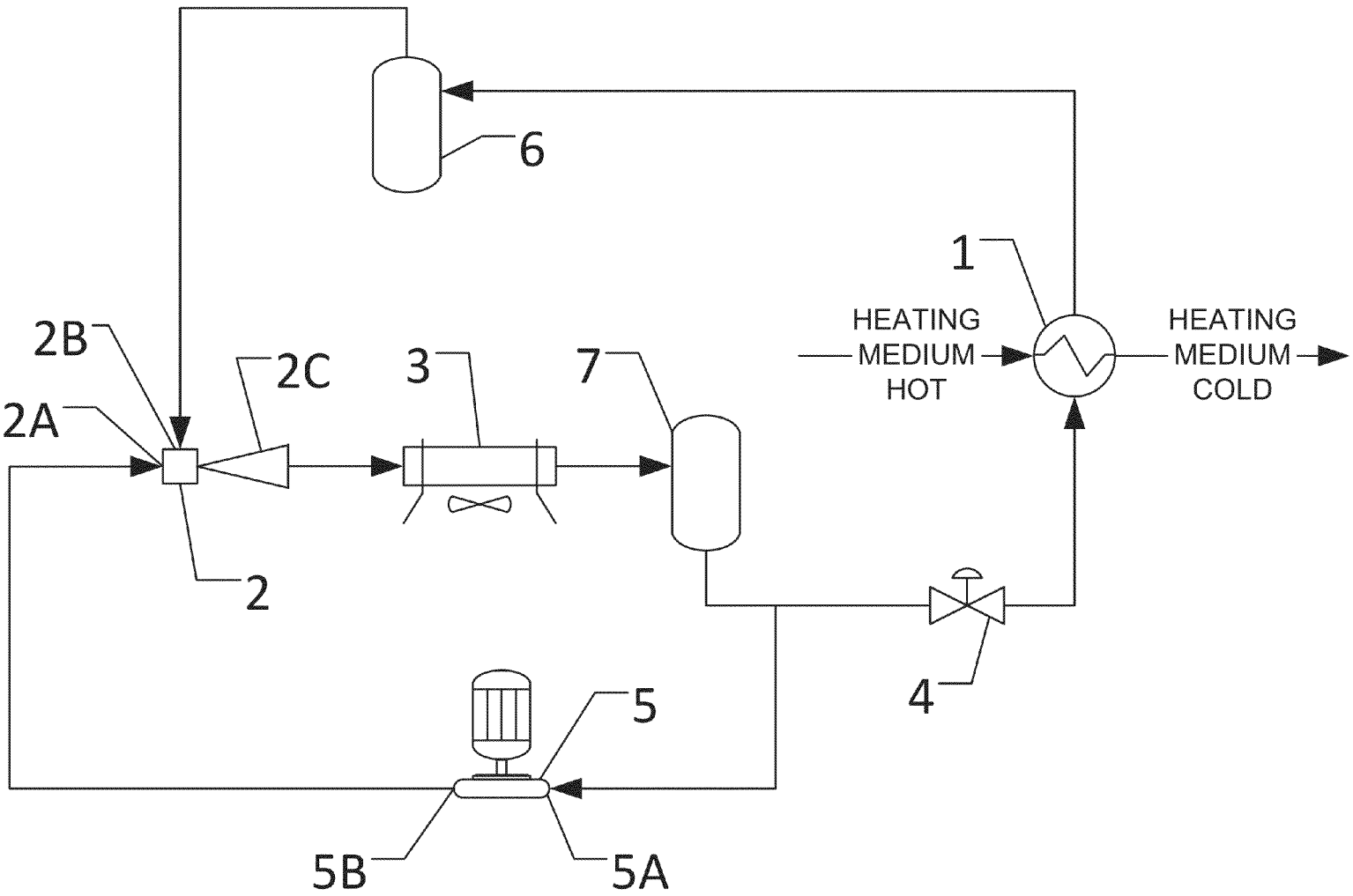
FIG. 3 shows a schematic diagram of the example refrigeration and heat pumping unit, which includes an accumulator drum and a liquid knockout drum.

FIG. 3 shows a schematic diagram of the example refrigeration and heat pumping unit, which further includes an accumulator (6) and a liquid knockout drum (7). The accumulator (4) may be a separator or two-phase separator which separates liquid from vapors and prevents any vapors entrained with the liquid from being communicated to the suction port (5A) of the circulating pump (5).

The liquid knockout drum (7) vapor outlet port is connected to the vapor inlet port (2B) of the condensing liquid-jet ejector (2), wherein the liquid inlet port (2A) thereof is connected to the discharge port (5B) of the circulating pump (5), and condensed liquid from the liquid-jet ejector liquid outlet nozzle (2C) is directed to the second heat exchanger (3). The liquid cooled in the second heat exchanger (3) is directed to the accumulator drum (6). A portion of cooled liquid from the second heat exchanger (3) is sent to the suction port (5A) of the circulating pump (5), and another portion thereof is directed to the pressure reducing device (e.g., a valve) (4) and then to the first heat exchanger (1).

Figure 4:
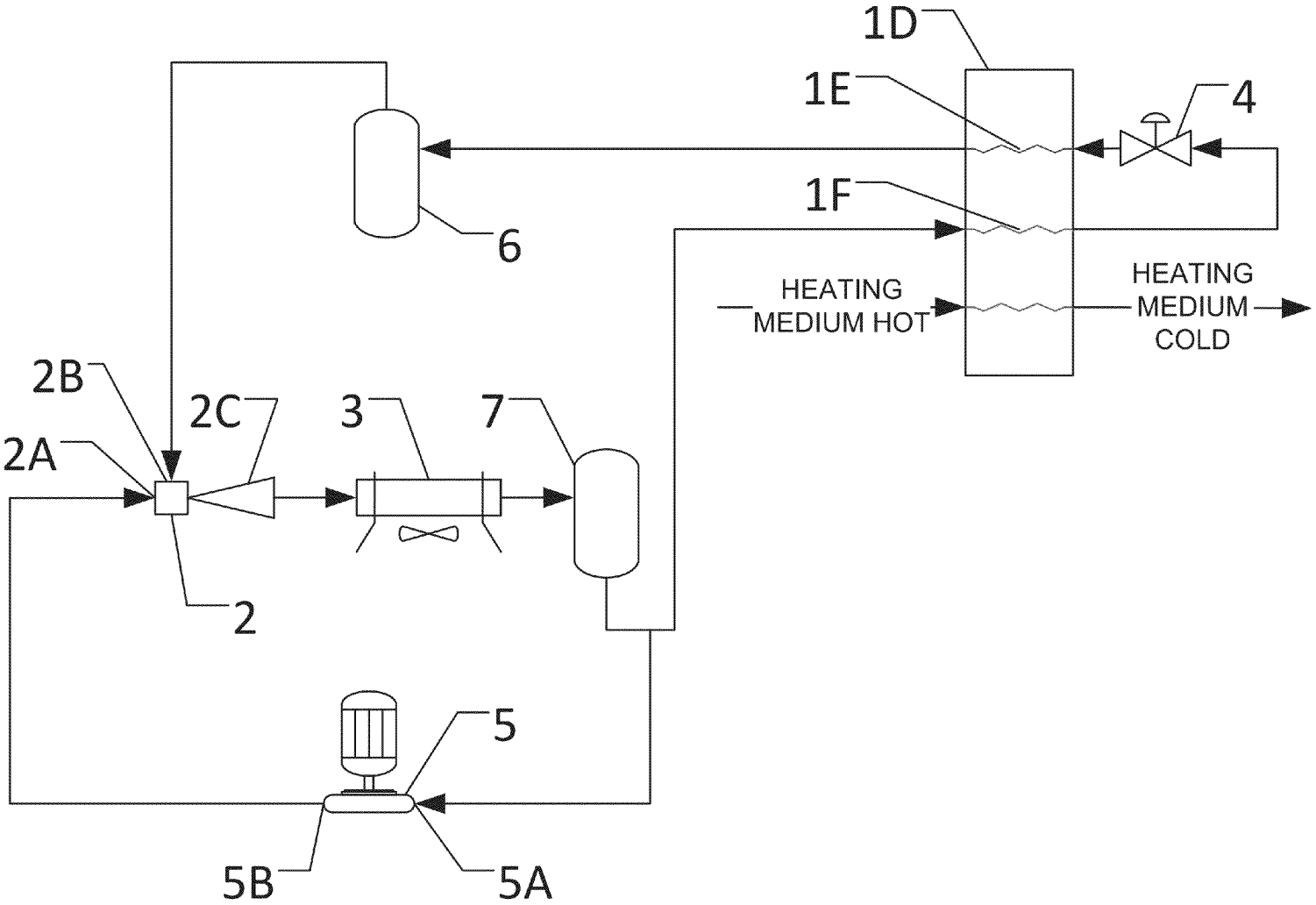
FIG. 4 shows a schematic diagram of a different example refrigeration and heat pumping unit, which includes an accumulator drum and a liquid knockout drum.

FIG. 4 shows a schematic diagram of a different example refrigeration and heat pumping unit, which includes an accumulator drum and a liquid knockout drum.

The liquid knockout drum (6) vapor outlet port is connected to the vapor inlet port (2B) of the condensing liquid-jet ejector (2), The liquid inlet port (2A) thereof is connected to the discharge port (5B) of the circulating pump (5), and condensed liquid from liquid-jet ejector liquid outlet nozzle (2C) is directed to the second heat exchanger (3). Liquid cooled in the second heat exchanger (3) is directed to the accumulator drum (7), wherein a portion of the cooled liquid from the second heat exchanger (3) is sent to the suction port (5A) of the circulating pump (5), and another portion of the cooled liquid is directed to a multi-pass heat exchanger (1D) wherein the pressure reducing device (valve) (4) is located between a first heat exchanger pass (1F) and a second heat exchanger pass (1E).

Figure 5:
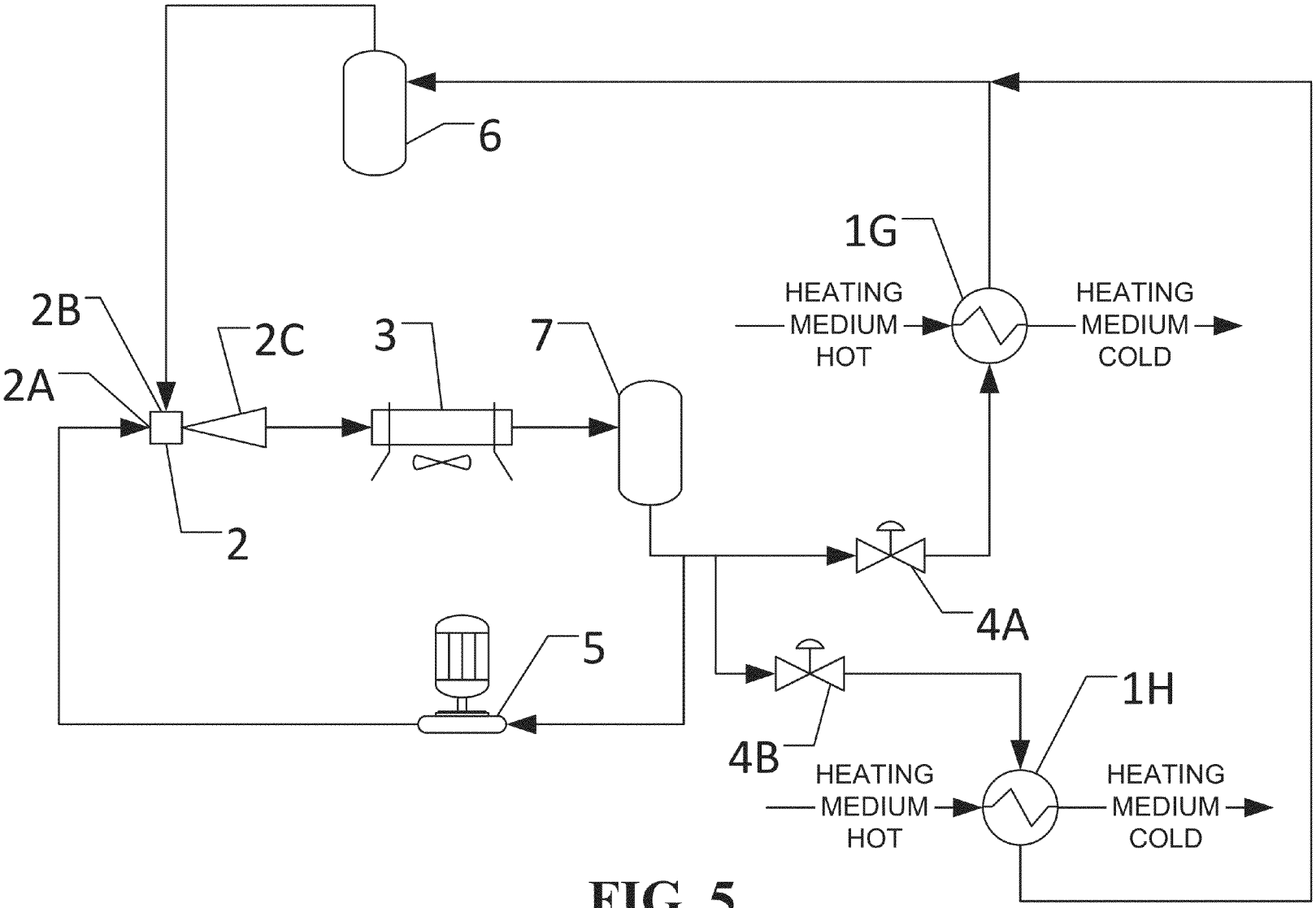
FIG. 5 shows a schematic diagram of an example refrigeration and heat pumping unit with two parallel heaters, which includes an accumulator drum and a liquid knockout drum.

FIG. 5 shows a schematic diagram of an example refrigeration and heat pumping unit with two parallel first heat exchangers (1G and 1H). The example in FIG. 5 may include an accumulator drum (6) and a liquid knockout drum (7)

The liquid knockout drum (7) vapor outlet port is connected to the vapor inlet port (2B) of the liquid-jet ejector (2), wherein the liquid inlet port (2A) thereof is connected to the discharge port (5B) of the circulating pump (5). Condensed liquid from the liquid-jet ejector liquid outlet nozzle (2C) is directed to the second heat exchanger (3), wherein cooled liquid from the heat exchanger (3) is directed to the accumulator drum (4). A portion of cooled liquid from the second heat exchanger (3) is sent to the suction port (5A) of the circulating pump (5). Another two portions of liquid from the heat exchanger (3), is each directed to a corresponding pressure reducing device (e.g., valves) (4A) and (4B) and then to corresponding first heater exchangers (1G) and (1H). The parallel first heat exchangers (1G, 1H) perform similar functions to the first heat exchanger (1) shown in FIG. 1 and the two-pass heat exchanger (1D) shown in FIG. 4.

The above described example refrigeration and heat pumping units can be applied in refinery, natural gas processing, chemical and petrochemical, food and other industries, as well as in residential air conditioning and refrigeration applications.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A heat pumping unit comprising:

a first heat exchanger;

a second heat exchanger;

a pump;

wherein an outlet of the first heat exchanger is connected to a vapor inlet of a liquid jet-ejector, a liquid outlet of the ejector is connected to an inlet of the second heat exchanger, an outlet of the second heat exchanger is connected at the same time to an inlet of the pump and through a pressure reducing device to an inlet of the first heat exchanger, wherein an outlet of the pump is connected to the liquid-jet ejector liquid inlet.

2. The heat pumping unit of claim 1, further comprising an accumulator connected between the outlet of the first heat exchanger and the vapor inlet of the liquid-jet ejector.

3. The heat pumping unit of claim 1, further comprising a liquid knock out drum connected between an outlet of the second heat exchanger and the pump inlet and the first heat exchanger inlet.

4. The heat pumping unit of claim 1 wherein the first heat exchanger is a multi-pass heat exchanger.

5. The heat pumping unit of claim 1 wherein the first heat exchanger comprises a pair of heat exchangers each having an inlet connected to an outlet of the second heat exchanger through a pressure reducing device, an outlet of each of the pair of heat exchangers coupled to the vapor inlet of the liquid-jet ejector.

6. The heat pumping unit of claim 1 further comprising a fan to move air through the second heat exchanger.

7. The heat pumping unit of claim 1 wherein the pressure reducing device comprises a valve.

* * * * *